US009101794B2

(12) United States Patent
Ferguson, Jr.

(10) Patent No.: US 9,101,794 B2
(45) Date of Patent: Aug. 11, 2015

(54) PIRI-STRETCHER

(76) Inventor: Thomas Alan Ferguson, Jr., San Francisco, CA (US)

( * ) Notice: Subject to any disclaimer, the term of this patent is extended or adjusted under 35 U.S.C. 154(b) by 456 days.

(21) Appl. No.: 13/563,291

(22) Filed: Jul. 31, 2012

(65) Prior Publication Data

US 2012/0295779 A1 Nov. 22, 2012

Related U.S. Application Data

(63) Continuation-in-part of application No. 12/885,511, filed on Sep. 19, 2010, now abandoned.

(51) Int. Cl.

| | |
|---|---|
| ***A63B 21/02*** | (2006.01) |
| ***A63B 21/00*** | (2006.01) |
| ***A63B 71/00*** | (2006.01) |
| *A63B 23/00* | (2006.01) |

(52) U.S. Cl.

CPC ..... *A63B 21/1423* (2013.01); *A63B 21/00185* (2013.01); *A63B 2023/006* (2013.01); *A63B 2208/0252* (2013.01)

(58) Field of Classification Search

CPC ..... A63B 21/00138; A63B 21/00156; A63B 21/00185; A63B 21/002; A63B 21/0023; A63B 21/14; A63B 21/1423; A63B 2023/006

USPC ..... 482/51, 91, 92, 121, 122, 124, 126, 482/131, 139, 907; 2/22, 24; 128/882; 602/23, 26

See application file for complete search history.

(56) References Cited

U.S. PATENT DOCUMENTS

| | | | | |
|---|---|---|---|---|
| 5,004,228 | A | 4/1991 | Powers | |
| 5,014,692 | A * | 5/1991 | Rhoades | 602/23 |
| 5,221,252 | A * | 6/1993 | Caprio et al. | 602/63 |
| 5,490,826 | A | 2/1996 | Rose | |
| 5,634,873 | A | 6/1997 | Carlstrom | |
| 5,779,655 | A * | 7/1998 | Holden | 602/5 |
| 6,315,748 | B1 | 11/2001 | Morgan, Jr. | |
| 6,338,700 | B1 | 1/2002 | Pollock | |
| 6,422,981 | B1 | 7/2002 | Riser | |
| 6,610,023 | B2 | 8/2003 | Steponovich | |
| 7,329,214 | B1 * | 2/2008 | Norman | 482/140 |
| 7,335,167 | B1 | 2/2008 | Mummy et al. | |
| 7,438,921 | B2 | 10/2008 | First | |
| 2008/0171065 | A1 | 7/2008 | O'Brien | |
| 2008/0183171 | A1 | 7/2008 | Elghazaly et al. | |
| 2009/0239723 | A1 * | 9/2009 | Jovanovic | 482/131 |
| 2009/0291807 | A1 | 11/2009 | Moring, Jr. et al. | |

* cited by examiner

*Primary Examiner* — Oren Ginsberg

(74) *Attorney, Agent, or Firm* — Steven A. Nielsen; www.NielsenPatents.com

(57) ABSTRACT

A system for stretching the piriformis muscle may comprise a thigh strap, calf strap and handle assembly. One or two handles may be presented. The system may be attached to the thigh and calf of a first leg. While the knee of the first leg is bent, the ankle of the second leg my rest upon the thigh strap attached to the first leg. A handle may be pulled to urge the piriformis muscle into a more elongated position.

7 Claims, 16 Drawing Sheets

PIRI-STRETCHER

RELATED PATENT APPLICATION AND INCORPORATION BY REFERENCE

This is utility application is a continuation in part of pending U.S. patent application Ser. No. 12/885,511 filed on Sep. 19, 2010. This related application is incorporated herein by reference and made a part of this application. If any conflict arises between the disclosure of the invention in this utility application and that in the related application, the disclosure in this utility application shall govern. Moreover, the inventor incorporates herein by reference any and all patents, patent applications, and other documents hard copy or electronic, cited or referred to in this application and the related application.

COPYRIGHT AND TRADEMARK NOTICE

This application includes material which is subject or may be subject to copyright and/or trademark protection. The copyright and trademark owner has no objection to the facsimile reproduction by any of the patent disclosure, as it appears in the Patent and Trademark Office files or records, but otherwise reserves all copyright and trademark rights whatsoever. No trademark rights to the term "Piri-Stretcher" or any other term are waived herein.

BACKGROUND OF THE INVENTION (1) Field of the Invention

The invention generally relates to devices enabling stretches. More particularly, the invention relates to means and methods of stretching the elusive piriformis muscle.

(2) Description of the Related Art

The related art is focused upon repair or palliative measures to address the after the fact damage inflicted by a tight piriformis muscle. A tight piriformis muscle is known to cause Piriformis Syndrome, sciatic nerve impingement and other serious ailments.

U.S. Patent Publication 2008/0183171 by Elghazaly et al published on Jul. 31, 2008 discloses orthopedic hardware that is screwed into a femur as part of a reconstruction piriformis fixation procedure. The disclosed hardware and method includes the use of piriformis lag screws that pass through a piriformis implant. While the Elghazaly disclosure is focused upon repairing a broken femur due to trauma, the Elghazaly disclosure emphasizes the importance of carefully positioning and carefully considering the piriformis muscle.

U.S. Pat. No. 7,335,167 by Mummy issued on Feb. 26, 2008 discloses a software system and apparatus to measure deviations of posture caused by various ailments and issues recommendations such as generic piriformis stretches. The Mummy reference provides no means or methods of stretching the piriformis muscle.

U.S. Patent Publication 2009/0291807 by Moring, J R. et al published on Nov. 26, 2009 discloses an exercise platform stood upon by those inflicted with Piriformis Syndrome. The Moring platform is not invasive but fails to isolate the piriformis muscle or otherwise stretch the piriformis muscle.

U.S. Patent Publication 2009/0286661 by Campbell discloses a foot trap and strap system used to facilitate leg and stride stretching. But, Campbell does nothing to enable bent knee stretches and fails to consider the need to isolate stretches for the piriformis muscle.

U.S. Pat. No. 8,025,617 by Tennant et al issued on Sep. 27, 2011 discloses a boot and straight leg stretch system to stretch the hamstring muscle. Tennant teaches straight leg raises with no bend in the knees and fails to address the piriformis muscle.

U.S. Pat. No. 6,689,028 by Smith issued on Feb. 10, 2004 discloses a planar non-bending board with a hand strap. The Smith appliance provides planar leg support just below the knee in the calf area to facilitate straight leg raises. Smith teaches away from bent knee stretches and fails to address the piriformis muscle.

U.S. Patent Publication 2003/0224019 by O'Brien published on Dec. 4, 2003 discloses the injection of various toxins to relieve nerve impingement. The O'Brien reference gives an excellent summary of Piriformis Syndrome leading to sciatic pain, stating at paragraph [0024] O'Brien states: "Sciatic pain can be caused by compression of the sciatic nerve by the piriformis muscle. This condition is commonly referred to as sciatica and is quite common in the middle-aged and elderly. The piriformis muscle extends from the pelvic surface of the sacrum to the upper border of the greater trochanter of the femur and, during running or sitting, can squeeze the sciatic nerve at the site where the nerve emerges from under the piriformis to cover the germellus and obturator internus muscles"

While the O'Brien reference mentions various physical positions to test for Piriformis Syndrome, O'Brien states that stretching exercises are "rarely beneficial" and that forcibly raising the knee often aggravates symptoms. Thus, O'Brien teaches away from stretching exercises to treat Piriformis Syndrome and instead encourages injections of botulinum type B toxin. Given that O'Brien is a recent reference and eschews stretching, there is long felt need in the art for less invasive means of preventing and treating Piriformis Syndrome.

BRIEF SUMMARY OF THE INVENTION

The present invention overcomes shortfalls in the related art by presenting an unobvious and unique combination, configuration and use of physical components to assist a user in stretching the piriformis muscle. Current embodiments of the invention have achieved unexpected results in relieving aliments caused by a tight piriformis muscle. The favorable results of the disclosed embodiments are unobvious in light of the prior art, such as O'Brien teaching specifically away from stretching and teaching the use of pharmaceutical solutions.

The disclosed embodiments are also unobvious in light of the prior art stretching devices. For example, U.S. Pat. No. 5,004,228 by Powers issued on Apr. 2, 1991 discloses a general rope structure used to flex feet in an upward position. The rope of Powers fails to describe or anticipate bent knee stretches and fails to address the piriformis muscle.

Disclosed embodiments facilitate the stretch of the piriformis muscles, giving the user added control, range of motion, comfort and grip. A disclosed embodiment comprises a thigh strap, calf strap and handle assembly to secure both the calf and thigh. The attached handle system may be centered over the knee area to control the knee area even when the knee is bent. A disclosed configuration of components allows a user to bend a knee, pull the knee back toward the body and cross the opposite leg over the knee area. A marked area upon the thigh strap gives users a target area to rest the ankle of their opposite leg over the secured knee area. Alternatively, a user may rest the back side of knee of their opposite leg over the secured knee area.

In the best mode known to date, a piri-stretcher is secured around the calf and thigh area such that the handle assembly is centered over the knee. The user lies upon their back and places a foot or ankle area over the marked area of the thigh strap. The operator grasps a handle of the handle assembly and gently, gradually and smoothly pulls toward their chest for a period of time. In the best mode known to date, the time period is approximately 60 seconds and the stretch is performed three times per side per day.

REFERENCE NUMERALS IN THE DRAWINGS

Figure 1:
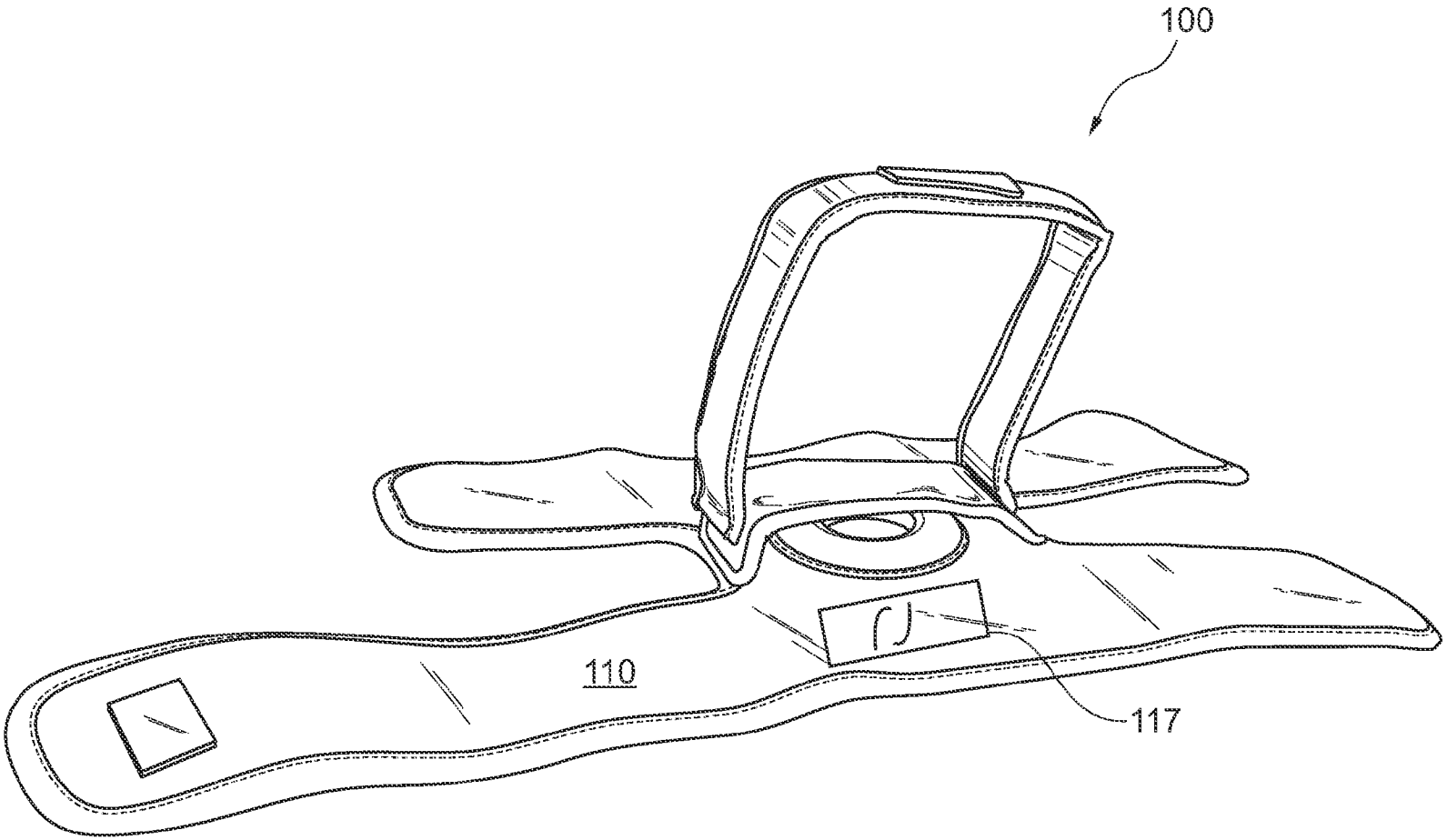
FIG. 1 is a top perspective view of a disclosed piri-stretcher.

100 an embodiment of the invention in general sometimes called a piri-stretcher or Piri-Stretcher™.

110 a thigh strap

111 an upper surface of the thigh strap 110

112 a lower surface of the thigh strap 110

113 a thigh hook section sometimes found upon the lower surface of the thigh strap 110

114 attachment points sometimes securing the thigh hook section 113, the attachment points 114 sometimes seen upon the upper surface of the thigh strap 110

115 a minor section of the thigh strap, sometimes defined as the shorter strap section starting at a center point of the circular collar and ending at the outer end.

116 a major section of the thigh strap, sometimes defined as the longer strap section, as compared to the minor section, starting at a center point of the circular collar and ending at the outer end.

117 placement markings for angle or calf placement

120 a calf strap

121 a upper surface of the calf strap 120

122 a lower surface of the calf strap 120

123 a calf hook section sometimes found upon the lower surface of the calf strap 120

124 attachment points sometimes securing the calf hook section 123, the attachment points sometimes seen upon the upper surface of the calf strap 120

125 a minor section of the calf strap 120, sometimes defined as the shorter section of strap, starting at the midpoint of the circular collar and extending to the outer end of the minor section.

126 a major section of the calf strap 120, sometimes defined as the longer section of strap, starting at the midpoint of the circular collar and extending to the outer end of the major section.

150 a center assembly of a disclosed piri-stretcher

160 center material attached to the calf strap 120 and thigh strap 110

170 a circular collar found upon the center material 160

171 an upper surface of the circular collar, the upper surface sometimes being convex in relation to the surrounding center material 160

172 a lower surface of the circular collar, the lower surface sometimes being convex or planar in relation to the surrounding center material 160

173 an outer perimeter of the circular collar 170

175 an inner perimeter of the circular collar, the inner perimeter defining a knee cap void

180 a knee cap void, defined by the inner perimeter 175 of the circular collar 170

200 a handle assembly

210 a lower handle sometimes attached to the center material 160

212 a lower surface of the lower handle 210

214 an upper surface of the lower handle 210

215 a handle connection area sometimes connecting the upper handle to the lower handle

220 an upper handle, sometimes attached to the lower handle 210

221 optional logo section upon upper handle 220

222 a lower surface of the upper handle 220

224 an upper surface of the upper handle 220

400 a human being in general

410 a calf of a human being

430 a right leg of a human being

440 a left leg of a human being

445 ankle area of a human being

446 a thigh of a human being

450 hands of a human being

500 a piriformis muscle

505 a directional arrow pointing to a piriformis muscle

510 a sciatic nerve

515 a directional arrow pointing to a sciatic nerve

These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

FIG. 1 depicts an embodiment in general 100 having a placement markings 117 upon the thigh strap 110.

Figure 2:
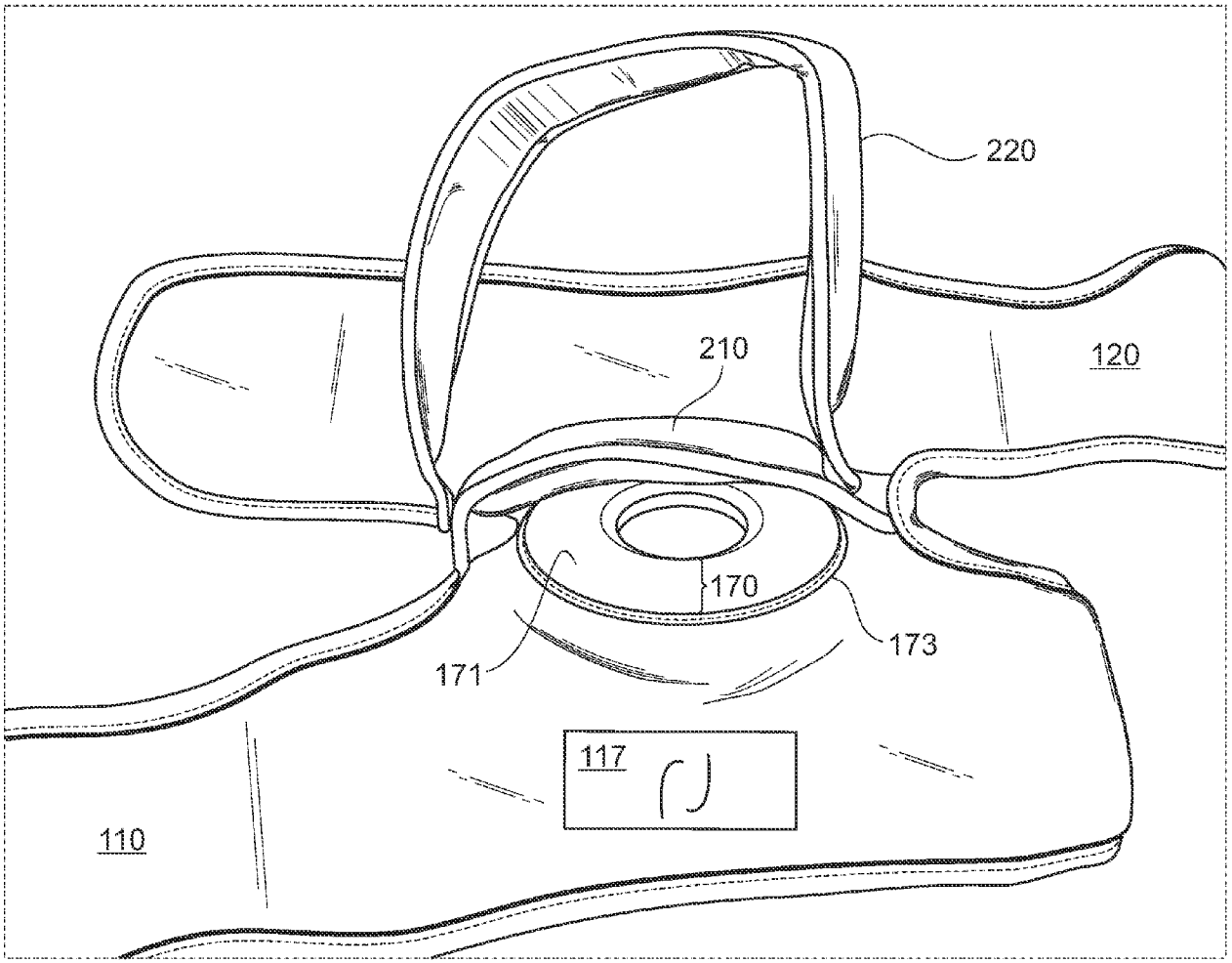
FIG. 2 is an enlarged view from FIG. 1.

FIG. 2 depicts a section of a piri-stretcher and shows a thigh strap 110 having placement markings 117, the placement marking sometimes used as reference marks for a user to place an ankle, foot or knee from the unsecured leg. An upper handle 220 is shown above a lower handle 210, with both handles centered over a circular collar 170. The circular collar 170 having an upper surface 171 and an outer perimeter 173.

Figure 3:
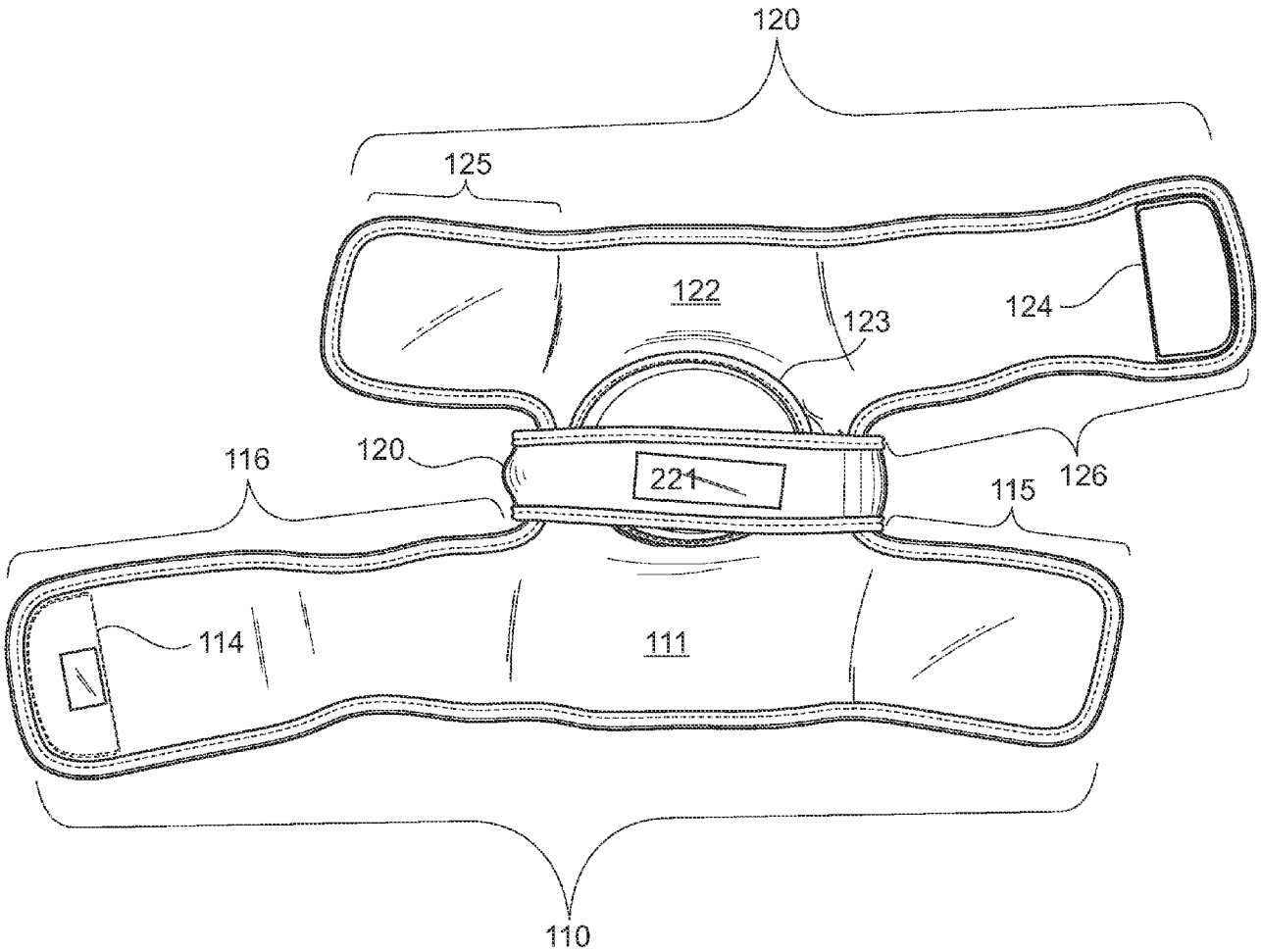
FIG. 3 is a top plan view of a disclosed piri-stretcher.

FIG. 3 depicts a top plan view showing a thigh strap 110 comprising a major section 116 being longer in length as compared to the minor section 115 of the thigh strap. The thigh strap having attachment points 114 or attachment seams sometimes securing a thigh hook section (not shown) found upon the bottom surface of the thigh strap.

FIG. 3 depicts an upper handle 120 having an optional logo area 221. The upper handle 120 is sometimes centered over a circular collar, the circular collar shown with an outer perimeter 173. A calf strap 120 comprises a major section 126 being longer in length as compared to the minor section 125. The major section 126 of the calf strap is shown with attachment points 124 or seams sometimes securing a calf hook section (not shown).

Figure 4:
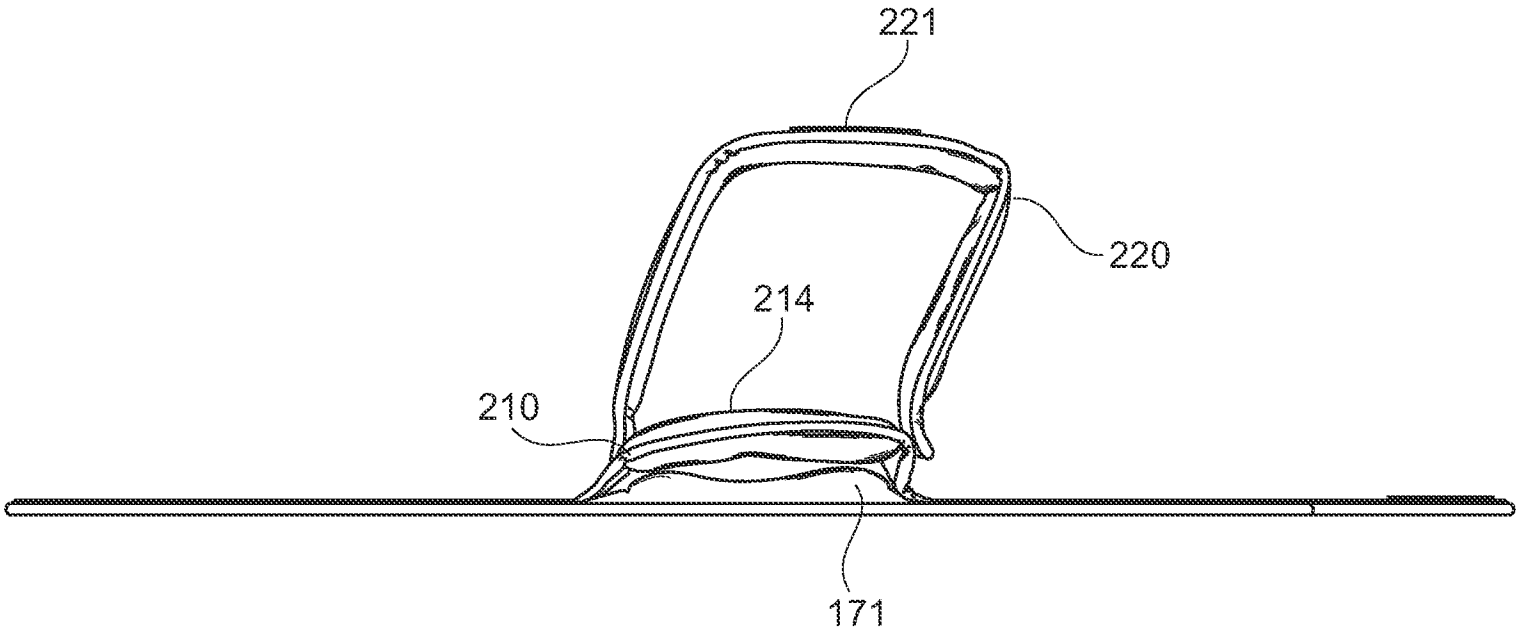
FIG. 4 is a left side view of a disclosed piri-stretcher.

FIG. 4 depicts an upper handle 220, an optional logo section 221 upon the upper or top handle 220. A lower handle 210 is shown with an upper surface 214. An upper surface 171 of a circular collar is shown underneath the lower handle 210.

Figure 5:
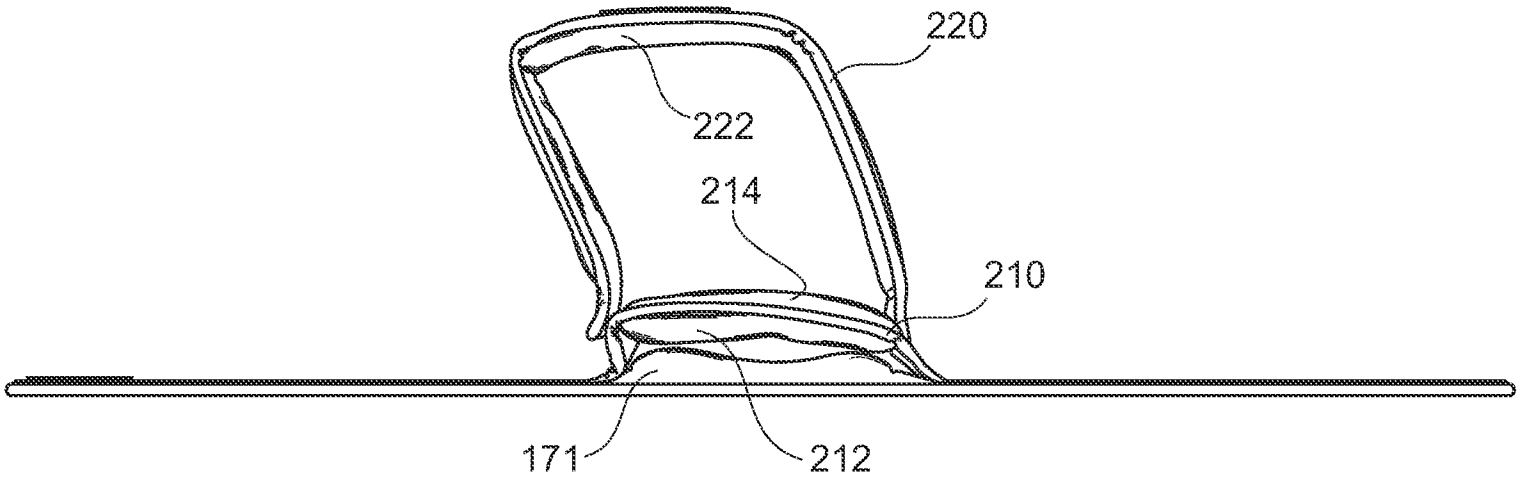
FIG. 5 is a right side view of a disclosed piri-stretcher.

FIG. 5 depicts an upper handle 220 with a lower surface 222. A lower handle 210 is shown with an upper surface 214 and a lower surface 212. Just below the lower handle, an upper surface 171 of the circular collar is shown.

Figure 6:
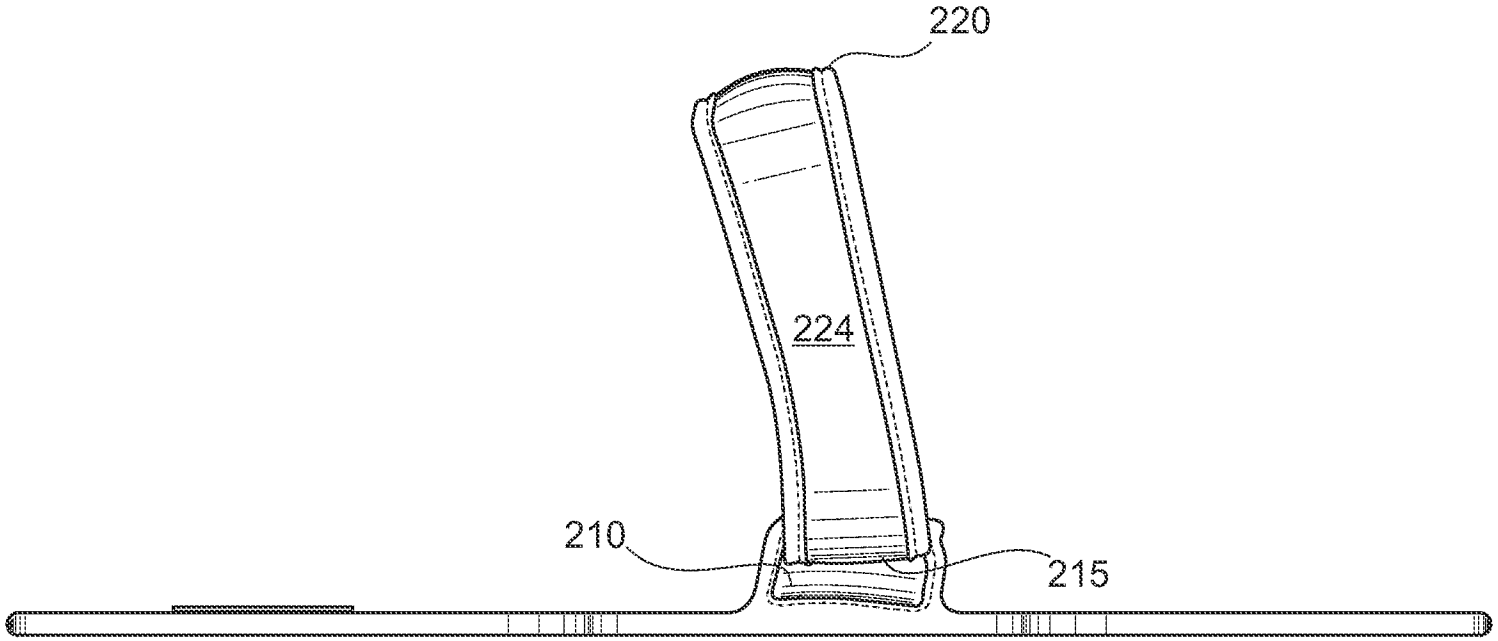
FIG. 6 is a rear side view of a disclosed piri-stretcher.

FIG. 6 depicts an upper handle 220 having an upper surface. A handle connection area 215 is shown and sometimes acts as an area of attachment securing the upper handle 220 to the lower handle 210.

Figure 7:
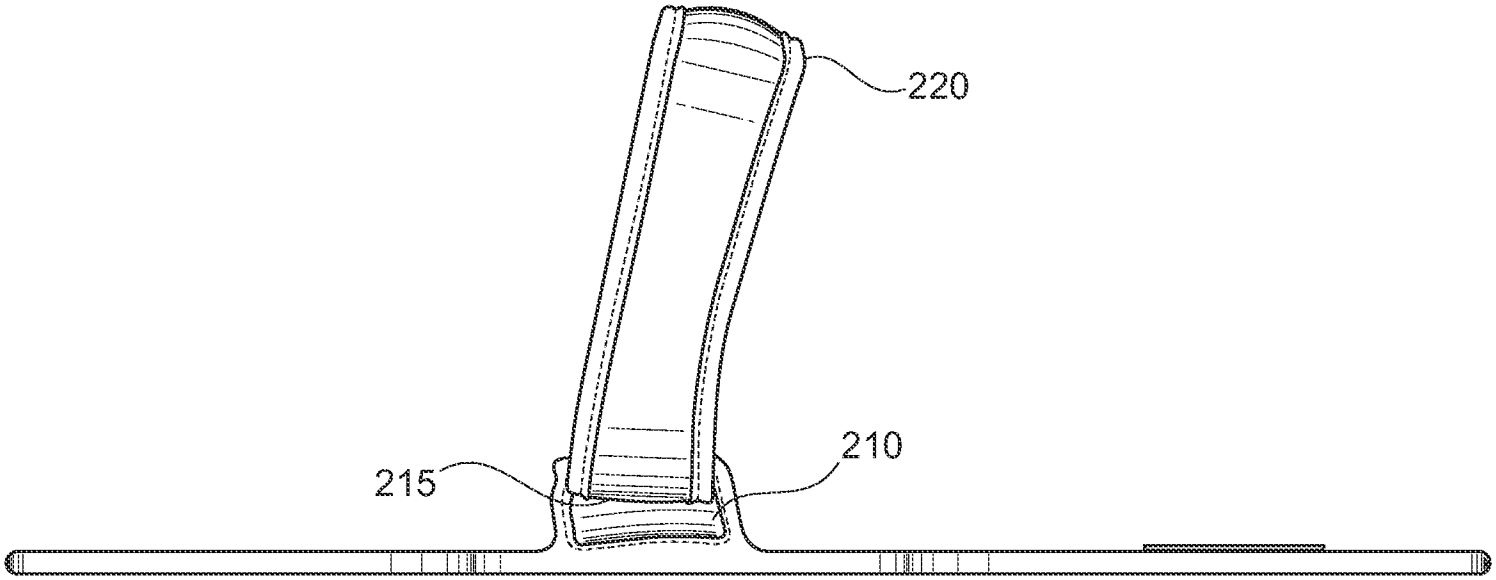
FIG. 7 is a front side view of a disclosed piri-stretcher.

FIG. 7 depicts a handle connection area 215 sometimes securing the upper handle 220 to the lower handle 210.

Figure 8:
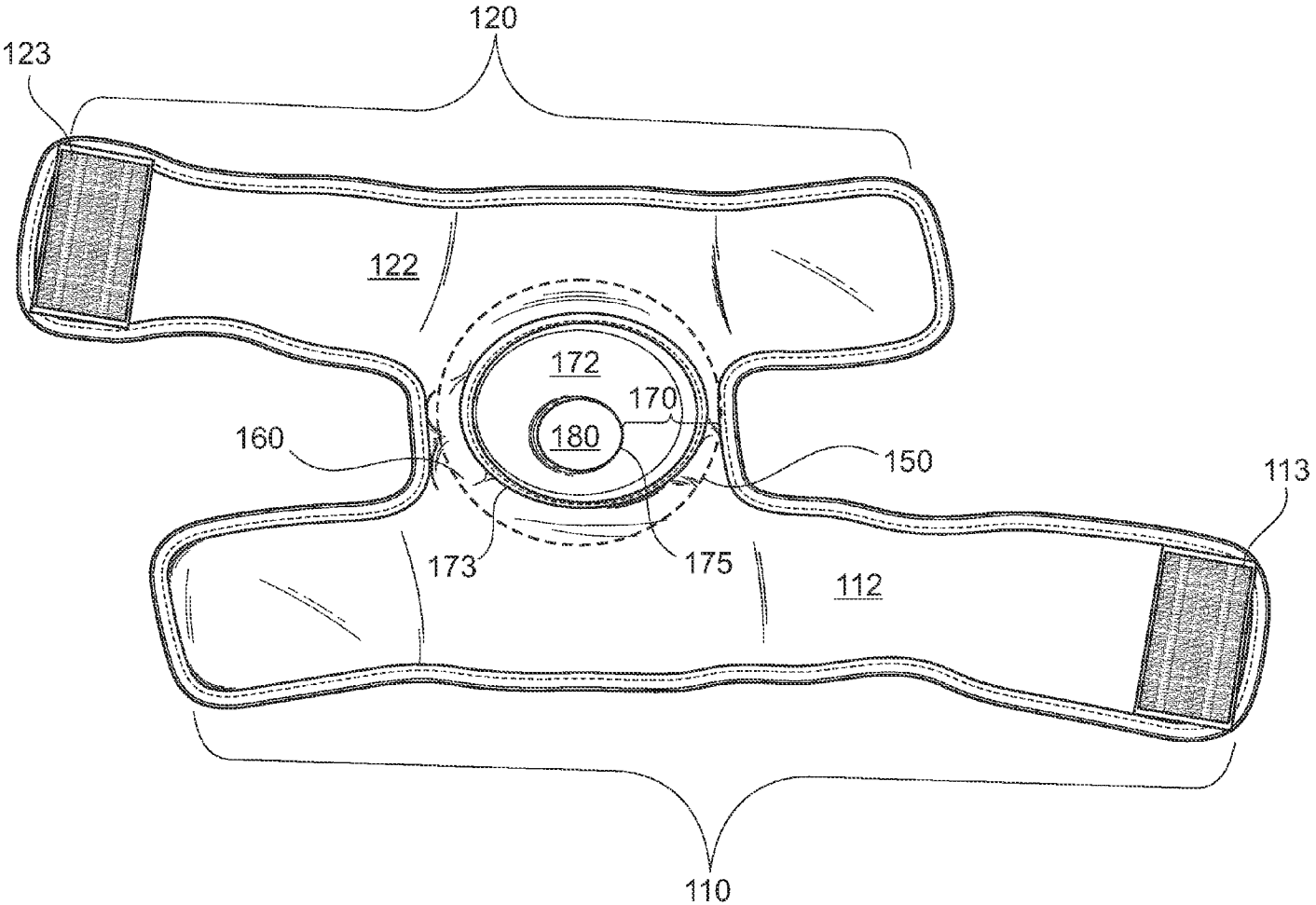
FIG. 8 is a bottom side view of a disclosed piri-stretcher.

FIG. 8 depicts a bottom side of a piri-stretcher having a thigh strap 110 comprising a lower surface 112 and a thigh hook section 113. The calf strap 120 comprises a lower surface and a calf hook section 123.

In FIG. 8, a center assembly 150 is found between the thigh strap 110 and the calf strap 120. The center assembly 150 comprises center material 160, the center material 160 sometimes connecting to both the thigh strap 110 and the calf strap 120.

Within the center material 160 contains a circular collar 170, the circular collar 170 defined by an outer perimeter 173 and an inner perimeter 175. A knee cap void 180 is defined by the inner perimeter 175 of the circular collar 170.

Figure 9:
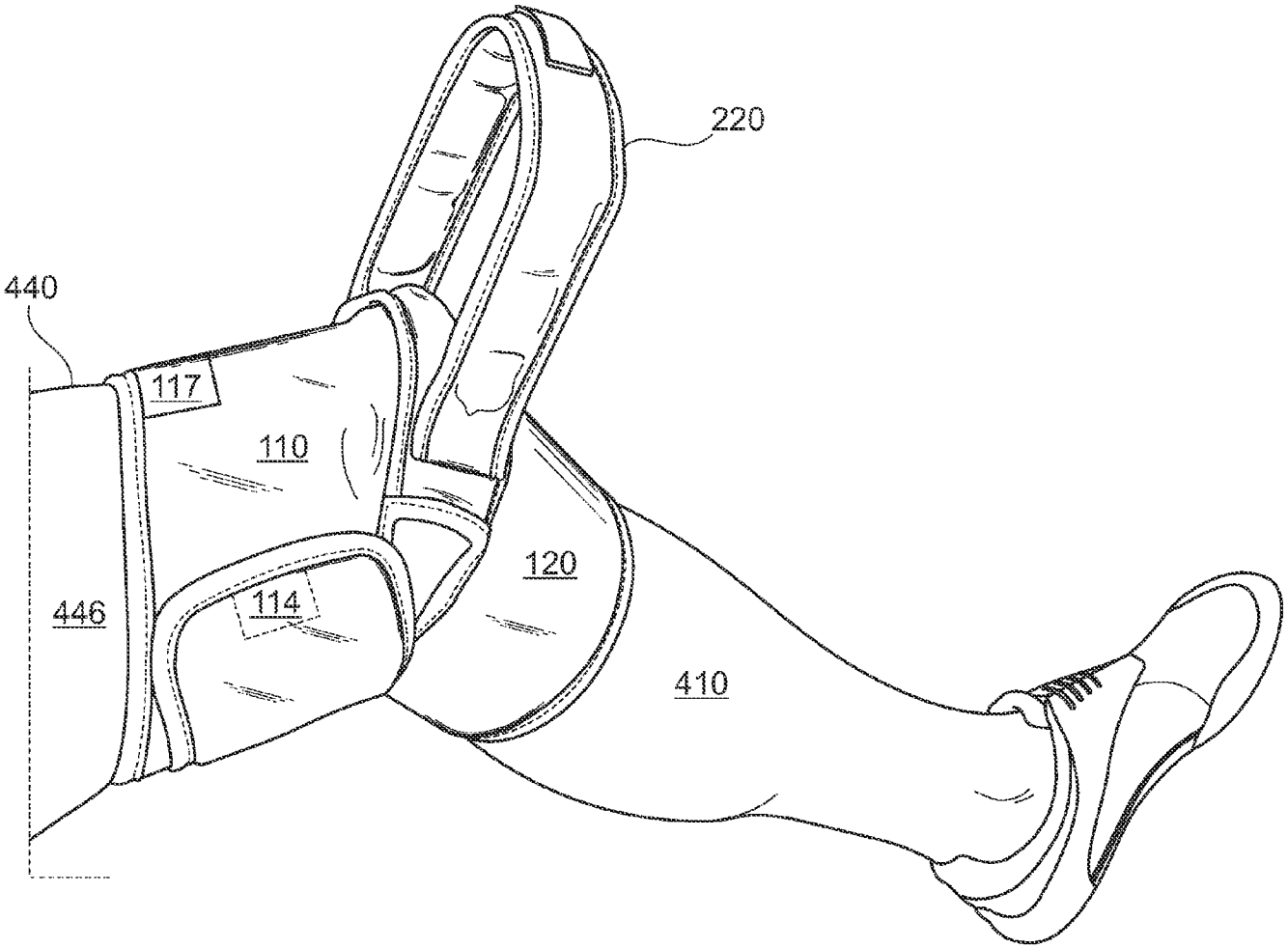
FIG. 9 is a perspective view of a disclosed piri-stretcher in a deployed position upon a leg.

FIG. 9 depicts a piri-stretcher in a deployed position with the thigh strap 110 secured around a thigh 446 and the calf strap 120 secured around a calf 410. Placement markings 117 are found upon the thigh strap. The upper handle 220 is shown in an upright position, ready to be grasped.

Figures 10, 11:
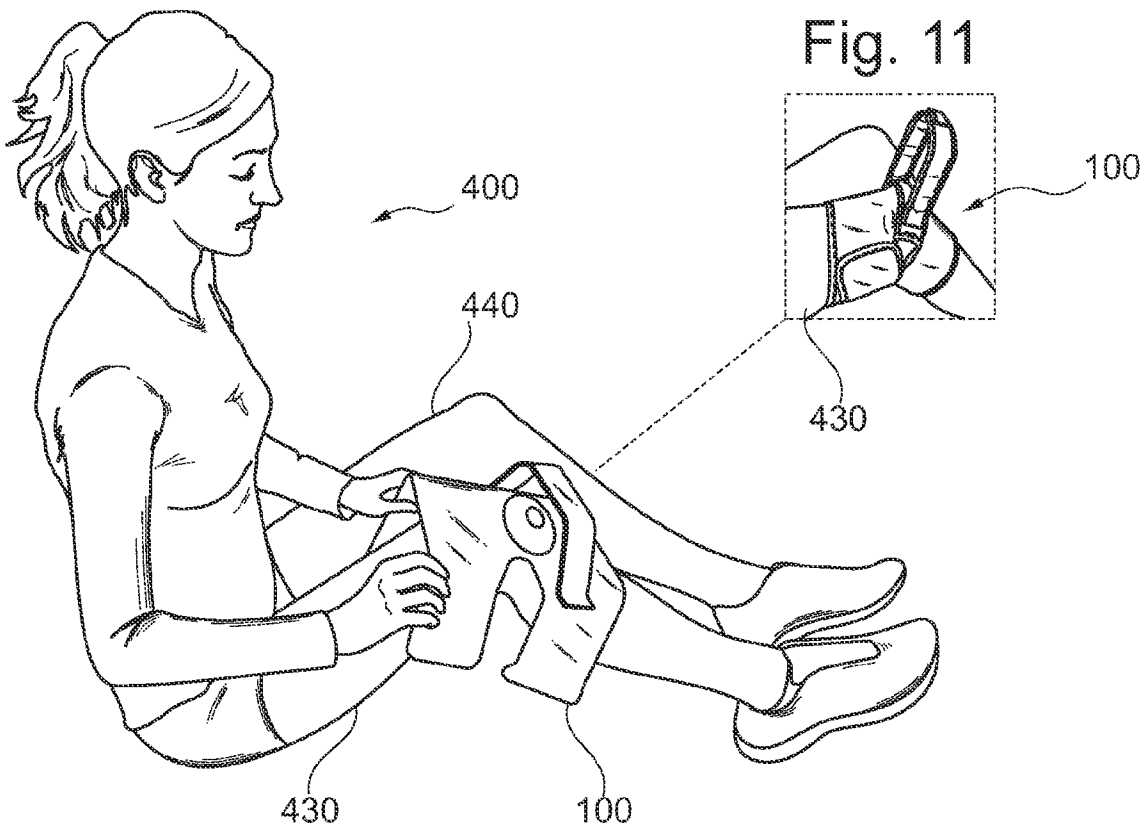
FIG. 10 is a perspective view of a disclosed piri-stretcher in an unfolded position upon a leg.
FIG. 11 is a perspective view of a disclosed piri-stretcher in a deployed position upon a leg.

FIG. 10 depicts a human 400 with a piri-stretcher 100 draped over her right leg 430. The left leg 440 is shown as free to cross over for stretching purposes.

FIG. 11 depicts a piri-stretcher 100 is a deployed position upon a right leg 430.

Figure 12:
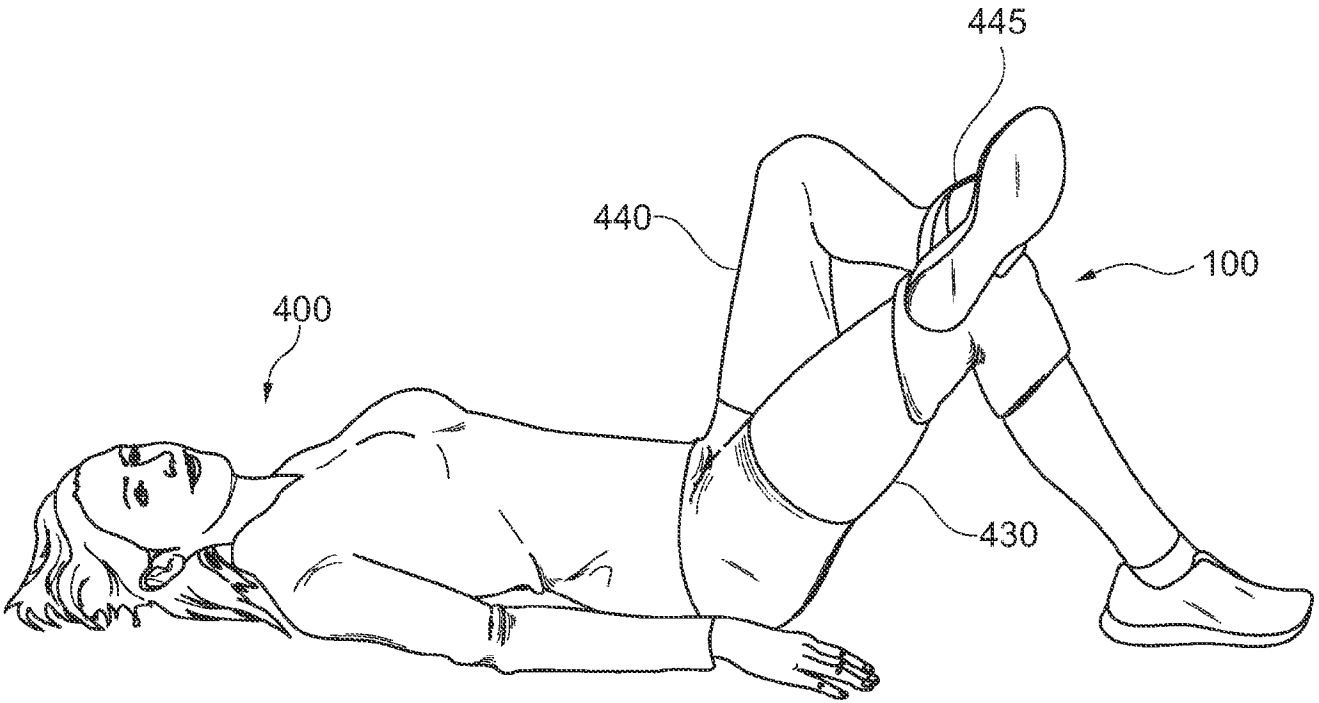
FIG. 12 is a perspective view of a disclosed piri-stretcher in a deployed position upon the right leg of a human, with the human's left angle placed upon the piri-stretcher.

FIG. 12 depicts a human 400 with her back upon the ground and with her left leg 440 crossed over, with the ankle area 445 placed upon a piri-stretcher 100, with her right leg 430 secured to the piri-stretcher.

Figures 13, 14:
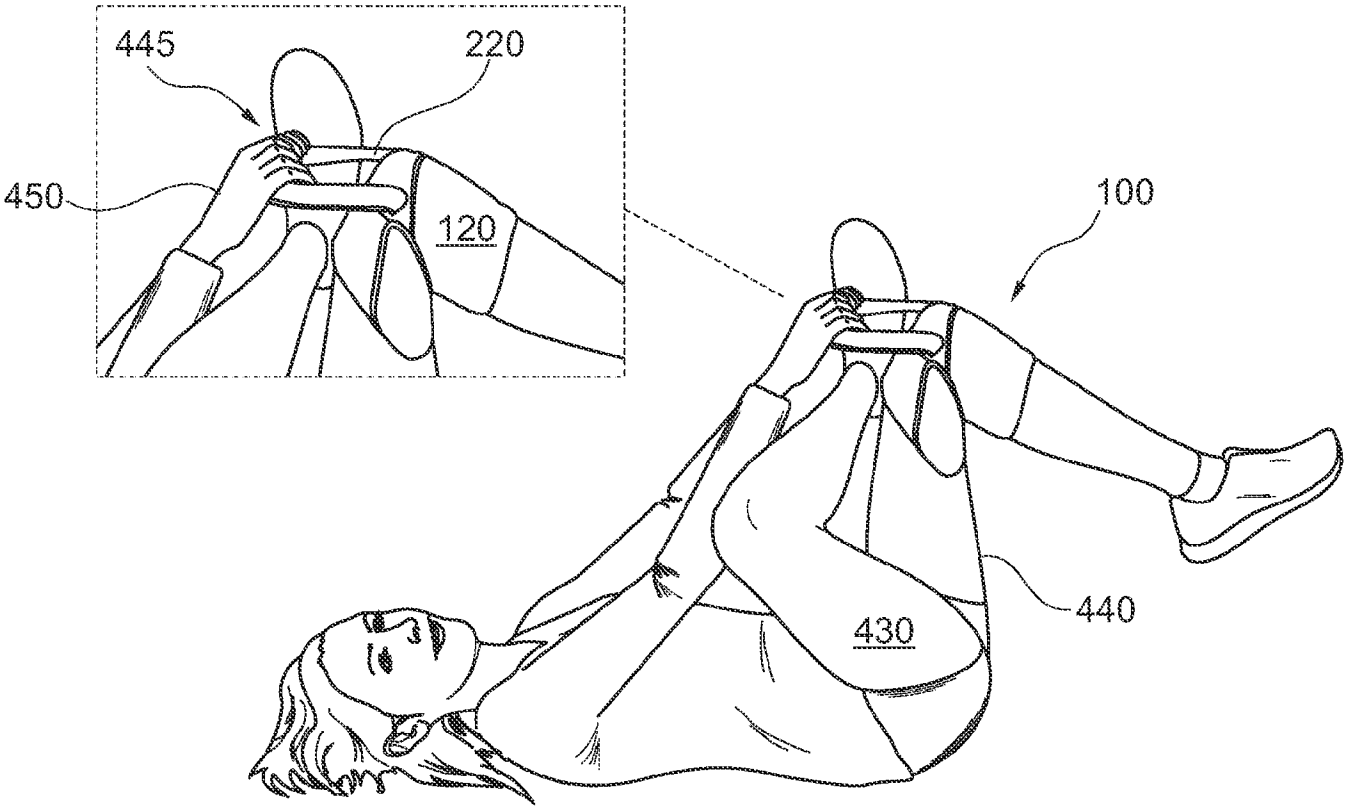
FIG. 13 is a perspective view of disclosed piri-stretcher in a deployed position upon the left leg of a human, with the human's right angle placed upon the piri-stretcher.
FIG. 14 is an expanded view of FIG. 13 showing a disclosed piri-stretcher.

FIG. 13 depicts a piri-stretcher 100 deployed upon a left leg 440 with a right leg 430 crossed over such that the ankle of the right leg is resting upon the piri-stretcher. FIG. 14 depicts the human's hands 450 grasping the upper handle 220 with the ankle area 445 of the right leg placed upon the thigh strap.

Figure 15:
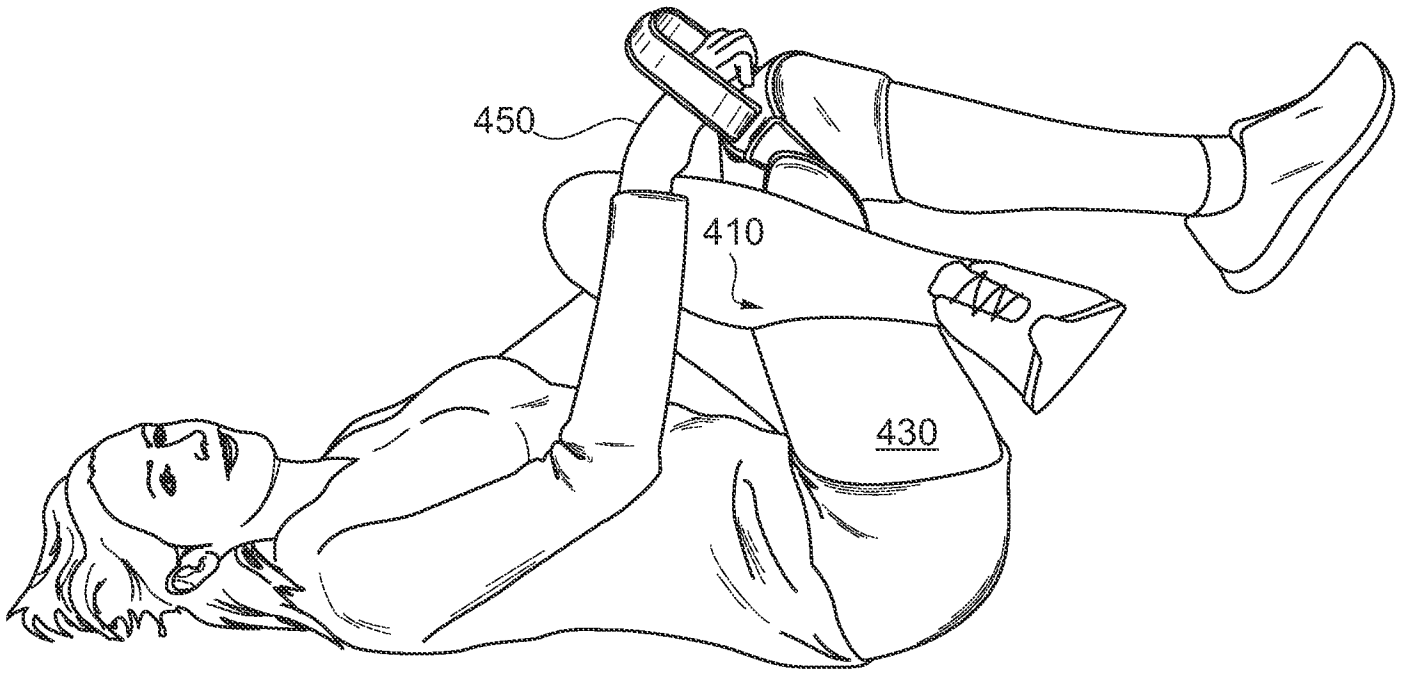
FIG. 15 is a perspective view of disclosed piri-stretcher in a deployed position upon the right leg of a human, with the human's left calf placed upon the piri-stretcher.

FIG. 15 depicts an alternative piriformis muscle stretch position wherein the lower strap is grasped with the human's hands 450 and the calf area or knee area of the unsecured leg rests upon the thigh strap, the thigh strap secured to the opposite leg.

Figure 16:
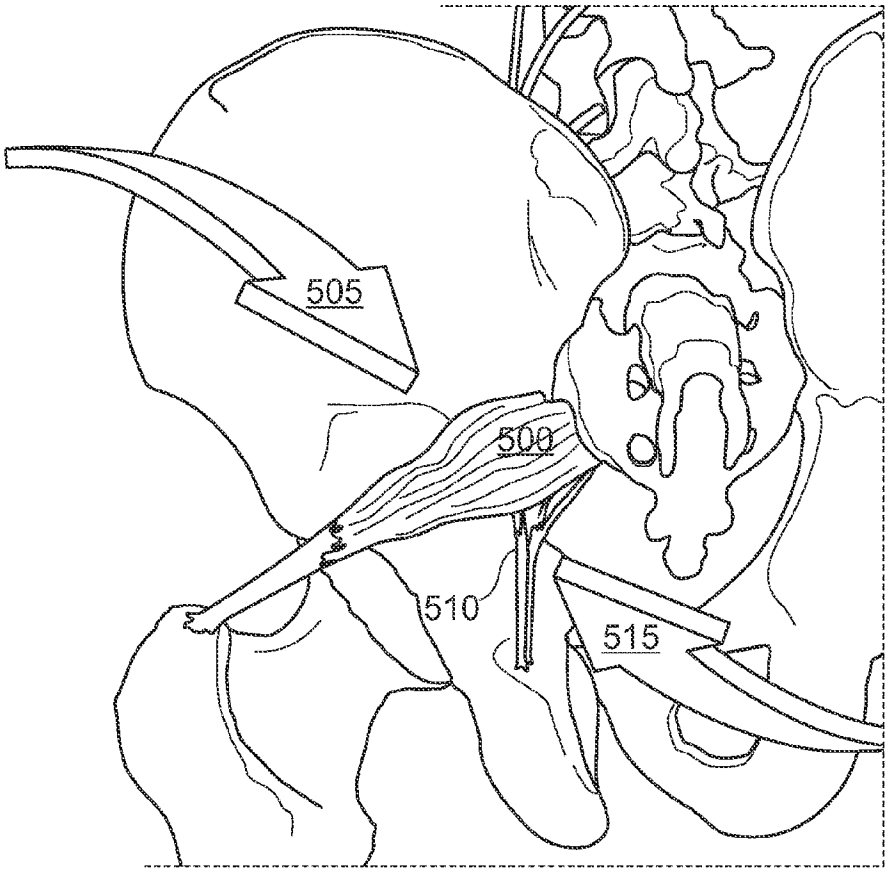
FIG. 16 is a perspective view of a human skeleton, showing a piriformis muscle and a sciatic nerve.

FIG. 16 depicts a human skeleton having a piriformis muscle 500 adjacent to a sciatic nerve 510. An upper directional arrow 505 points to the piriformis muscle 500 while a lower directional arrow 515 points to the sciatic nerve.

Figure 17:
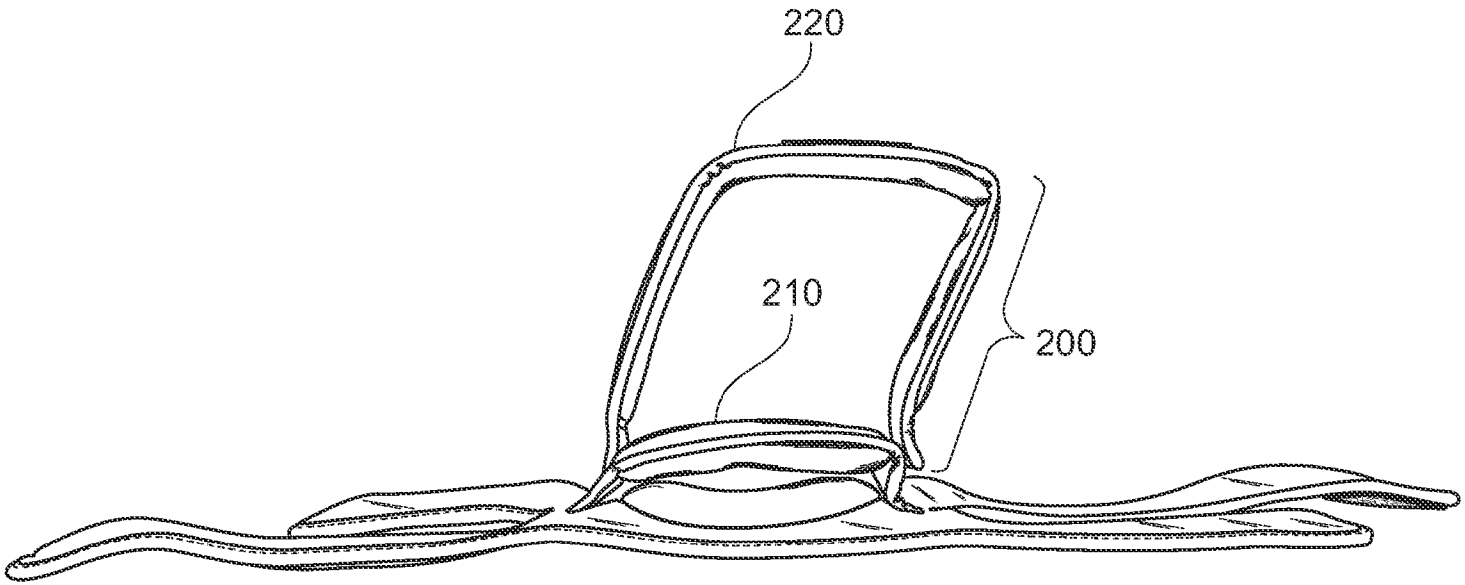
FIG. 17 is a side perspective view of a disclosed piri-stretcher.
Figure 18:
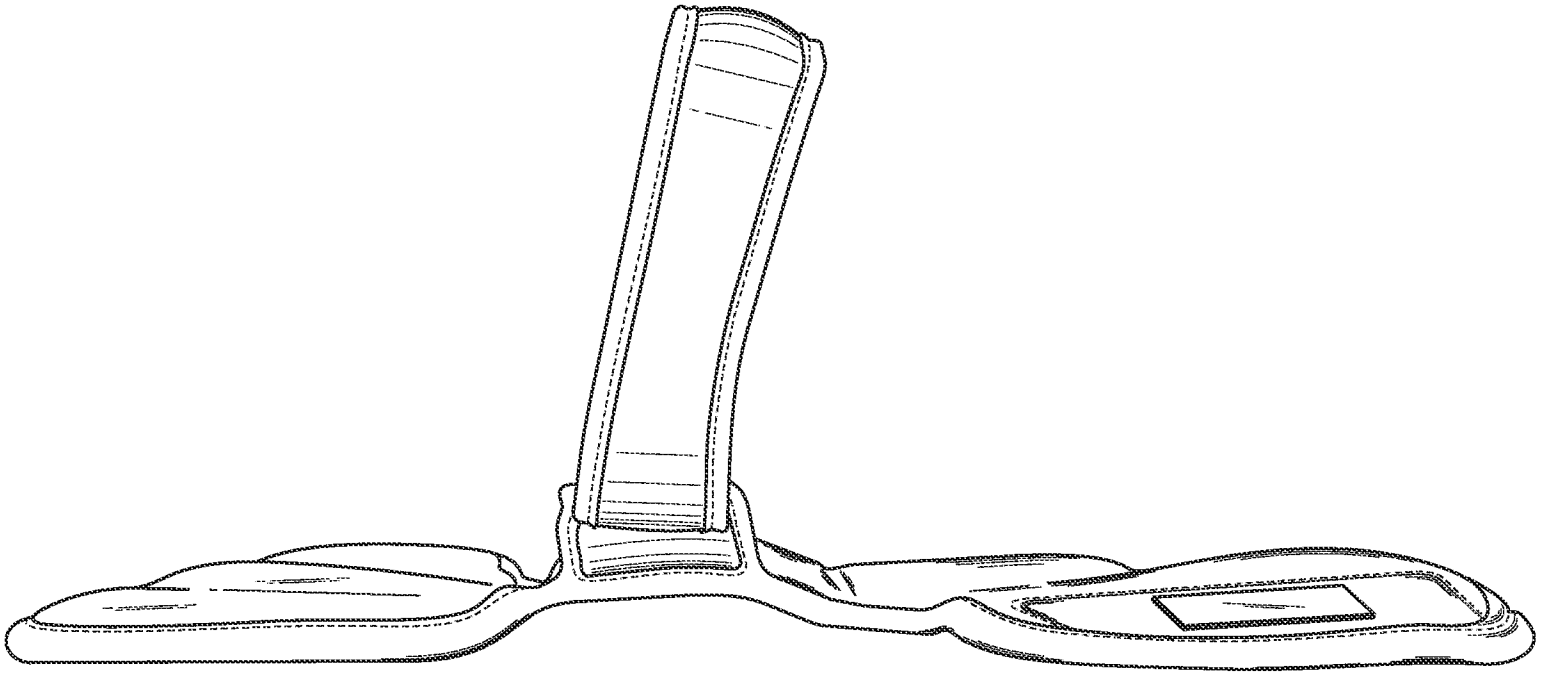
FIG. 18 is a front perspective view of a disclosed piri-stretcher.

FIG. 17 depicts a handle assembly 200 comprising a lower handle 210 and an attached upper handle 220.

Fig. depicts a depicts a piri-stretcher in a relaxed position.

In one embodiment, a piri-stretcher in a normal size may have a thigh strap of 21 to 27 inches and a calf strap of 17 to 22 inches. Material may comprise 3 mm neoprene and one handle may be supplied.

In the best mode known to date, the preferred embodiment will have a two handle system as illustrated, have a thigh strap of 23 to 29 inches, a calf strap of 19 to 24 inches. Material may comprise 4 mm neoprene.

Disclosed embodiments may include the following items.

Item 1. A system for stretching a piriformis muscle, the system comprising:

a thigh strap 110 comprising a major section 116 attached to a minor section 115, the thigh strap 110 having an upper side 111 and a lower side 112;

a center assembly 150 attached to the thigh strap, the center assembly comprising center material 160, a circular collar 170 attached to the center material 160, the circular collar further defined by an outer perimeter 173 and an inner perimeter 175;

a knee cap void 180 defined by the inner perimeter 175 of the circular collar 170;

a calf strap 120, attached to the center material 160, the calf strap 120 comprising a major section 126 and a minor section 125, the calf strap 120 having an upper surface 121 and a lower surface 122; and a lower handle 210 attached to the center material.

Item 2. The system of item 1 further comprising an upper handle 220 attached to the lower handle 210.

Item 3. The system of item 1 further comprising a thigh hook section 113 attached to the thigh strap 110 and a calf hook section attached to the calf strap 120.

Item 4. The system of item 3 further comprising the thigh hook section 113 attached to the bottom surface 112 of the thigh strap 110 and further comprising the calf hook section 123 attached to the bottom surface 122 of the calf strap 120.

Item 5. The system of item 3 wherein the major section 116 of the thigh strap 120 is adjacent to the minor section 125 of the calf strap 120.

Item 6. The system of item 5 wherein the top surface of the thigh strap and top surface of the calf strap are comprised of loop material capable of attachment to the thigh hook section 113 and calf hook section 123.

Item 7. The system of item 1 wherein the upper surface 112 of the thigh strap 110 further comprises placement markings 117 indicating the placement of an ankle upon the thigh strap 110.

Item 8. A method of stretching a piriformis muscle using the system of item 1, the method comprising the steps of:

attaching the thigh strap around the thigh of a first leg;

attaching the calf strap around the calf of the first leg;

bending the knee of the first leg;

placing an ankle of the second leg upon the thigh strap; and grasping the lower handle and pulling the lower handle.

Item 9. A kit for stretching the piriformis muscle, the kit comprising:

a thigh strap 110 comprising a major section 116, a minor section 115, an upper surface and a lower surface;

a center assembly 150 comprising center material 160 attached to a circular collar 170, the circular collar comprised of an outer perimeter 173 and an inner perimeter 175;

a knee cap void 180 defined by the inner perimeter 175 of the circular collar 170;

a calf strap 120 comprising a major section 126 and a minor section 125, calf strap having an upper surface 122 and a lower surface; and a lower handle.

Item 10. The kit of item 9 further comprising a second handle.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. A system for stretching a piriformis muscle, the system comprising:

a thigh strap comprising a major section attached to a minor section, the thigh strap having an upper side and a lower side;

a center assembly attached to the thigh strap, the center assembly comprising center material, a circular collar attached to the center material, the circular collar further defined by an outer perimeter and an inner perimeter;

a knee cap void defined by the inner perimeter of the circular collar;

a calf strap, attached to the center material, the calf strap comprising a major section and a minor section, the calf strap having an upper surface and a lower surface; and a lower handle comprising a first end and a second end, with the first end attached between the minor section of the calf strap and the major section of the thigh strap and the second end of the lower handle attached between the major section of the calf strap and the minor section of the thigh strap;

an upper handle with a first end attached upon the lower handle and a second end attached upon the lower handle.

2. The system of claim 1 further comprising a thigh hook section attached to the thigh strap and a calf hook section attached to the calf strap.

3. The system of claim 2 further comprising the thigh hook section attached to the lower surface of the thigh strap and further comprising the calf hook section attached to the lower surface of the calf strap.

4. The system of claim 2 wherein the major section of the thigh strap is adjacent to the minor section of the calf strap.

5. The system of claim 4 wherein the upper surface of the thigh strap and upper surface of the calf strap are comprised of loop material capable of attachment to the thigh hook section and calf hook section.

6. The system of claim 1 wherein the upper surface of the thigh strap further comprises placement markings indicating the placement of an ankle upon the thigh strap.

7. A kit for stretching the piriformis muscle, the kit comprising:

a thigh strap comprising a major section, a minor section, an upper surface and a lower surface;

a center assembly comprising center material attached to a circular collar, the circular collar comprised of an outer perimeter and an inner perimeter;

a knee cap void defined by the inner perimeter of the circular collar;

a calf strap comprising a major section and a minor section, calf strap having an upper surface and a lower surface; and a lower handle comprising a first end and a second end, with the first end attached between the minor section of the calf strap and the major section of the thigh strap and the second end of the lower handle attached between the major section of the calf strap and the minor section of the thigh strap;

an upper handle with a first end attached to the lower handle and the upper handle having a second end attached to the lower handle.

* * * * *